US006941784B2

(12) United States Patent
Koyama et al.

(10) Patent No.: US 6,941,784 B2
(45) Date of Patent: Sep. 13, 2005

(54) BENDING METHOD AND DEVICE THEREFOR

(75) Inventors: Junichi Koyama, Kanagawa (JP); Osamu Hayama, Kanagawa (JP); Hitoshi Omata, Kanagawa (JP); Kazunari Imai, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 329 days.

(21) Appl. No.: 10/169,744

(22) PCT Filed: Jan. 16, 2001

(86) PCT No.: PCT/JP01/00222

§ 371 (c)(1),
(2), (4) Date: Jul. 17, 2002

(87) PCT Pub. No.: WO01/53019

PCT Pub. Date: Jul. 26, 2001

(65) Prior Publication Data

US 2003/0010078 A1 Jan. 16, 2003

(30) Foreign Application Priority Data

Jan. 17, 2000 (JP) ..... P2002-008287

(51) Int. Cl.[7] ..... B21C 51/00; B21D 5/02

(52) U.S. Cl. ..... 72/31.1; 72/31.01; 72/702; 72/389.6

(58) Field of Search ..... 72/31.01, 31.1, 72/31.11, 389.6, 702, 389.3; 700/97, 145; 395/420, 660

(56) References Cited

U.S. PATENT DOCUMENTS

| | | | | | |
|---|---|---|---|---|---|
| 4,819,467 | A | * | 4/1989 | Graf et al. | 72/702 |
| 4,864,509 | A | * | 9/1989 | Somerville et al. | 72/702 |
| 5,148,693 | A | * | 9/1992 | Sartorio et al. | 72/31.1 |
| 5,839,310 | A | * | 11/1998 | Tokai et al. | 72/31.1 |
| 5,857,366 | A | * | 1/1999 | Koyama | 72/31.1 |
| 6,003,353 | A | | 12/1999 | Ootani et al. | |
| 6,035,242 | A | | 3/2000 | Uemura et al. | |
| 6,161,408 | A | * | 12/2000 | Ooenoki et al. | 72/31.01 |
| 6,539,763 | B1 | * | 4/2003 | Chebbi | 72/31.1 |
| 6,662,610 | B1 | * | 12/2003 | Sekita et al. | 72/31.1 |

FOREIGN PATENT DOCUMENTS

JP 6-262264 9/1994

* cited by examiner

*Primary Examiner*—David Jones
(74) *Attorney, Agent, or Firm*—Greenblum & Bernstein, P.L.C.

(57) ABSTRACT

A bending method includes determining a provisional bending stroke value that resulted in a predetermined angle during test bending. The bending method also includes calculating a stroke value correction amount for correcting the provisional bending stroke value, based on the number of times a test piece was contacted to obtain the predetermined angle during test bending. The stroke value correction amount is added to the provisional stroke value to obtain a corrected stroke value, so as to obtain the predetermined angle during operational bending using the corrected stroke value.

6 Claims, 5 Drawing Sheets

CORRECTION VALUE TABLE

SUS304 t1.2 88° V6 DR1.5 PR0.6

| TARGET ANGLE | TWICE STRIKING | THREE TIME STRIKING | FOUR TIME STRIKING | FIVE TIME STRIKING | SIX TIME STRIKING |
|---|---|---|---|---|---|
| 90° | 0.011 | → | → | → | → |
| 100° | ↓ | | | | |
| 110° | ↓ | | | | |
| 120° | ↓ | | | | |
| 130° | ↓ | | | | |
| 140° | ↓ | | | | |

BENDING METHOD AND DEVICE THEREFOR

TECHNICAL FIELD

The present invention relates to a bending apparatus and a bending method implemented in a bending apparatus.

BACKGROUND ART

Conventionally, in a bending apparatus such as a press brake, a plate-like work is bent to a desired predetermined angle using a punch and a die cooperatively.

For a bending process, a D value (stroke amount) is first established by "test" bending a work to a predetermined angle. The D value is the stroke amount that obtains the predetermined angle during the "test" bending.

The "test" bending includes a step of switching an NC control apparatus to a manual mode and thereafter driving a ram at a minute speed by a manual pulser. The driving of the ram is executed by an operator rotating a manual pulse handle to bend a work.

The D value is established as the stroke amount at a time when the predetermined angle, e.g., 90 degrees, is obtained during the test bending. After the D value is established, the D value is set to the NC control apparatus, and a continuous bending (a step of continuously bending multiple works) is executed as a "main bending" using the D value.

However, the predetermined angle cannot be reliably obtained in the main bending operation using the D value set to the NC control apparatus, for reasons explained herein. Accordingly, the angle obtained in main bending may be either too shallow or too deep when using the D value established during test bending.

DISCLOSURE OF THE INVENTION

The present invention has been made for the purpose of solving the problem mentioned above. Accordingly, an object of the present invention is to provide a bending apparatus and a bending method which can determine a D value correction amount. The D value correction amount is calculated for main bending, on the basis of a number of times a work is struck until a predetermined angle is established during test bending.

In order to achieve the object mentioned above, according to a first aspect of the present invention, there is provided a bending method that includes determining a provisional stroke value on the basis of a bending process condition. The determined provisional stroke value is expected to result in a predetermined angle during test bending. The method also includes reciprocating an upper table or a lower table on the basis of the provisional stroke value so as to execute a test bending process using a punch and a die which are attached to the upper table and the lower table. The test bending includes striking the work a number of times until the predetermined angle is obtained. Therefore, a stroke value correction amount is determined in correspondence to the number of strikes and the predetermined angle. The stroke value correction amount is calculated before the main bending using the number of strikes and the predetermined angle. The stroke value correction amount is added to the provisional stroke value to correct a stroke value used for the main bending.

According to a second aspect of the present invention, there is provided a bending apparatus. The bending apparatus includes an upper table and a lower table, one of which is capable of reciprocating. A punch and a die are attached to the upper table and the lower table, respectively. A bending process input interface is provided for inputting a bending process condition. A provisional stroke value calculator determines a provisional stroke value for the bending process condition. A strike number inputter or a strike number detector is provided for inputting or automatically detecting a number of times a work has been struck to obtain a predetermined angle during test bending. Test bending is executed on the basis of the provisional stroke value, and the number of times a test piece is struck is input or automatically detected. For main bending, a stroke value corrector determines a stroke value correction amount for a predetermined angle on the basis of the number of times the work is struck during test bending.

Therefore, according to the bending apparatus and method, the corresponding stroke value correction amount can be automatically computed for main bending on the basis of the predetermined angle, the number of times a test piece was struck during test bending, and the bending process condition during test bending. The stroke value correction amount is obtained by determining the data mentioned above in advance of the main bending, and in accordance with the number of strikes used to obtain the predetermined angle during the test bending.

That is, the main bending process is executed on the basis of the main bending stroke value which has been automatically corrected by adding the stroke value correction amount to the provisional stroke value. As a result, even when the test bending is executed by an unskilled operator and the work is struck multiple times until the desired predetermined angle is obtained, it is possible to easily and effectively execute a stable bending process.

BEST MODE FOR CARRYING OUT THE INVENTION

A description will be given in detail below of an embodiment of the present invention with reference to the accompanying drawings.

Figure 1:
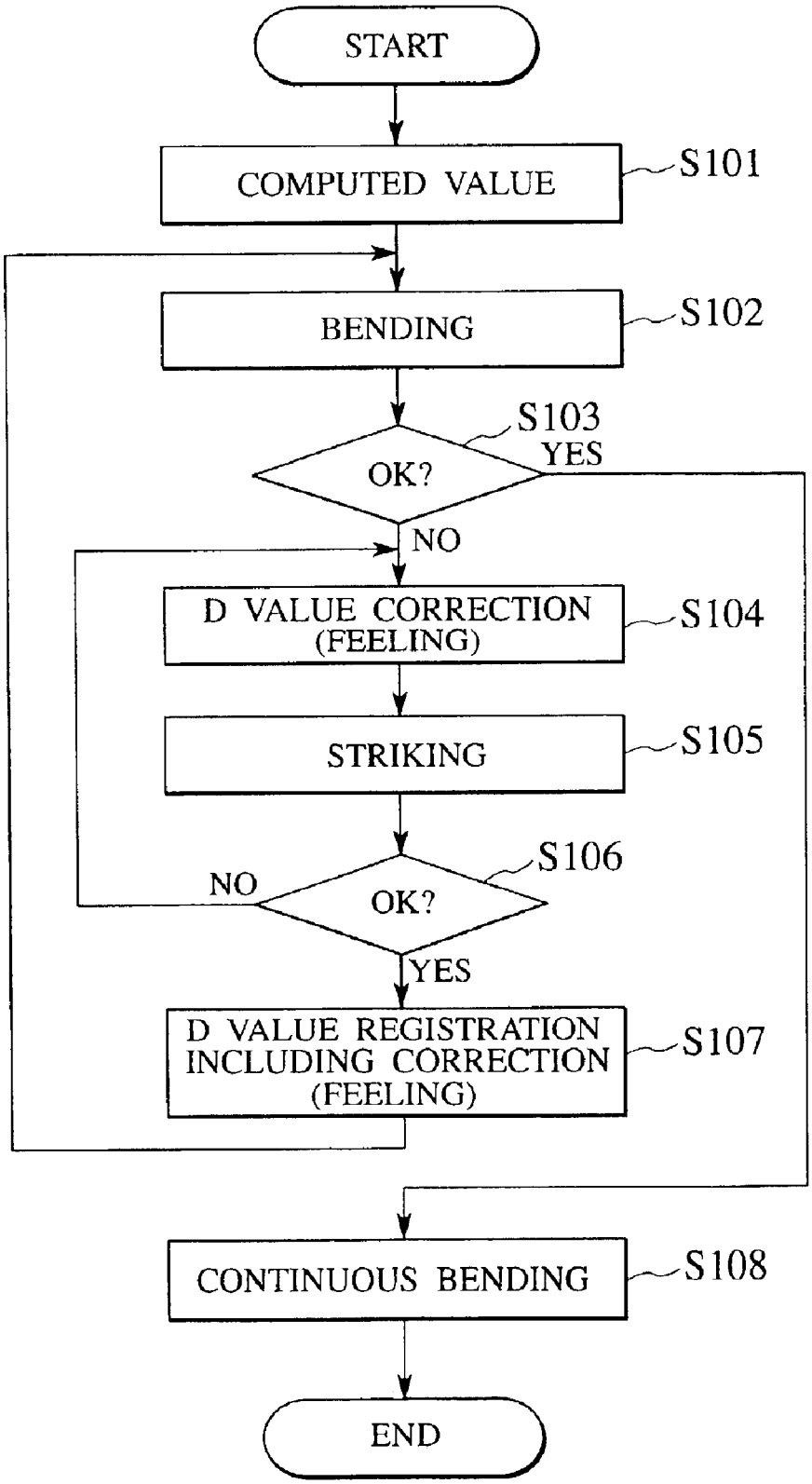
FIG. 1 is a flow chart of a bending method, according to an aspect of the present invention.

According to a bending method of the present invention, as shown in FIG. 1, a test bending process is executed after an elongation value is computed. If a bending angle is a predetermined angle, the step goes to a continuous bending process (steps S101 to S103 and S108).

In the case that an unskilled operator executes the test bending mentioned above, in order to obtain a desired predetermined angle, bending steps (steps S104 to S106) are repeated so as to measure a bending angle of the work. The bent work is taken out and then again mounted on a die. A manual pulser is rotated so as to execute bending using a punch and the die, and a ram is driven so as to drive in the bending angle.

After a D value (a stroke amount) is established that will obtain the predetermined angle in the test bending, the D value is set to an NC control apparatus (step S107), whereby a continuous bending (a step of continuously bending multiple works) is executed as a "main bending" (step S108).

In the bending method mentioned above, even if the D value which is determined during the test bending is set to the NC control apparatus and used during main bending, the predetermined angle is not necessarily achieved during main bending. Generally, the angle obtained during main bending becomes tighter(a narrower angle) than the predetermined angle.

Further, when a target angle correction is executed by striking the work multiple times during test bending to determine a D value for continuous bending, the D value may still not be accurate and will result in an angle that is too shallow or too deep. The test bending involves releasing the work from a press brake, for the purpose of measuring a spring back using an automatic angle correcting apparatus such as a bending indicator (B/I: a bending angle measuring apparatus) or the like, and again gripping the work between the punch and the die. However, the D value that results from multiple strikes may not be accurate for main bending that involves a single strike.

A description will be given in detail below of an embodiment of a bending apparatus and method employing a hydraulic press brake, with reference to FIGS. 2 to 7.

Figure 3:
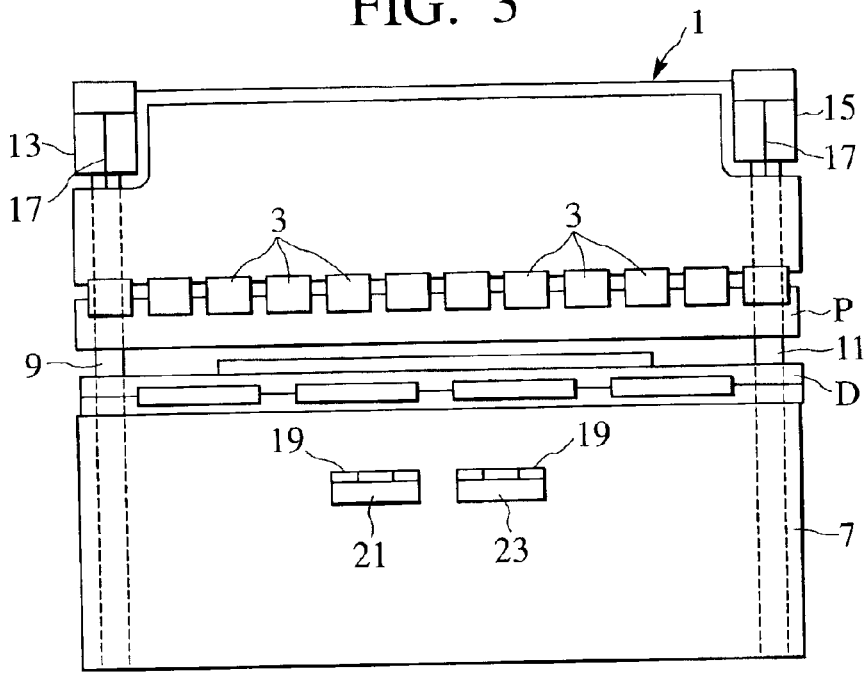
FIG. 3 is a schematic front elevational view of a press brake used in an embodiment, according to an aspect of the present invention.

With reference to FIG. 3, a press brake 1 according to the present embodiment is a descending type hydraulic press brake. However, the press brake 1 may be an ascending type press brake or a mechanical type press brake including a non-hydraulic crank type or the like.

The descending type hydraulic brake 1 is attached and fixed to a lower surface of a movable table capable of moving upward and downward. The movable table, e.g., an upper table 5, corresponds to a ram via multiple intermediate plates 3 in which punches P are arranged at a uniform interval. A die D is attached and fixed to an upper surface of a fixed table, e.g., a lower table 7. Accordingly, the upper table 5 moves downward, and a process for bending a work W (e.g., a plate member) is executed between the punch P and the die D according to a cooperation between the punch P and the die D.

Figure 2:
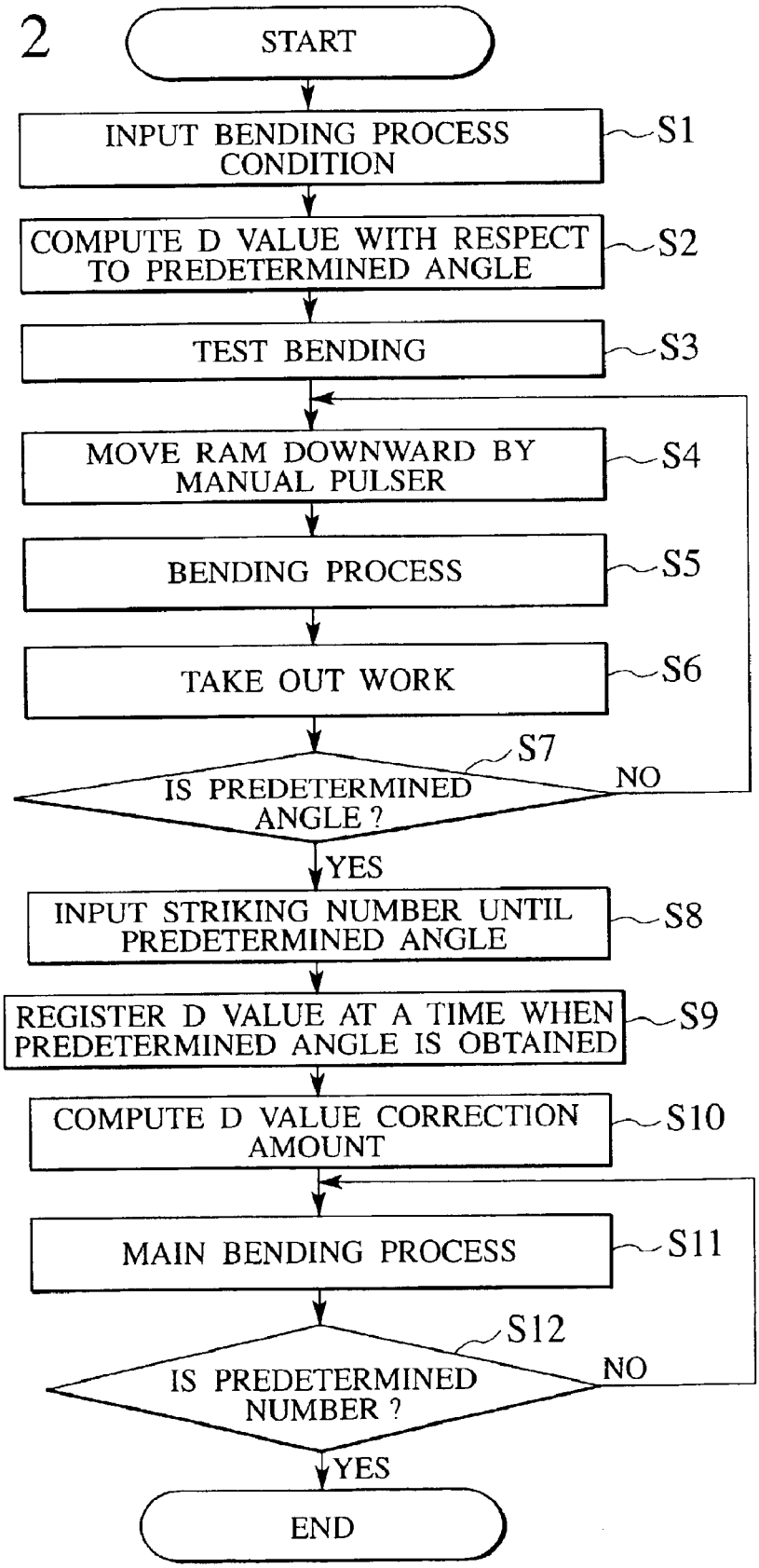
FIG. 2 is a flow chart of an improved bending method, according to an aspect of the present invention.

Left and right side frames 9 and 11 form a main frame body in FIG. 2. In upper portions of the left and right side frames 9 and 11 in FIG. 3, left shaft(axis) and right shaft (axis) hydraulic cylinders 13 and 15 are provided. The upper table 5 is connected to lower ends of piston rods 17 of the left shaft and right shaft hydraulic cylinders 13 and 15.

Further, the lower table 7 is fixed to lower portions of the left and right side frames 9 and 11. Notch portions 19 are provided in a center portion of the lower table 7. Two crowning apparatuses, e.g., crowning cylinders 21 and 23 (hydraulic cylinders), are provided in the notch portions 19. According to the structure shown in FIG. 3, pressure applied by pistons in the crowning cylinders 21 and 23 is controlled, whereby an amount of deflection in the center portion of the lower table 7 is adjusted.

Further, a control apparatus 25, such as an NC control apparatus or the like, is provided in the press brake 1 mentioned above. The control apparatus 25 is switched between a "test bending mode", during which a test bending process is manually executed by rotating a manual pulse handle (not shown), and a "continuous bending mode", during which a "main bending" is executed to continuously bend multiple works W. The upper table 5 is driven at a minute speed by a manual pulser during test bending. The main bending is executed after a D value (a stroke amount) is provided to the control apparatus 25. The D value for main bending is the D value when a predetermined angle is achieved by the test bending.

Figure 4:
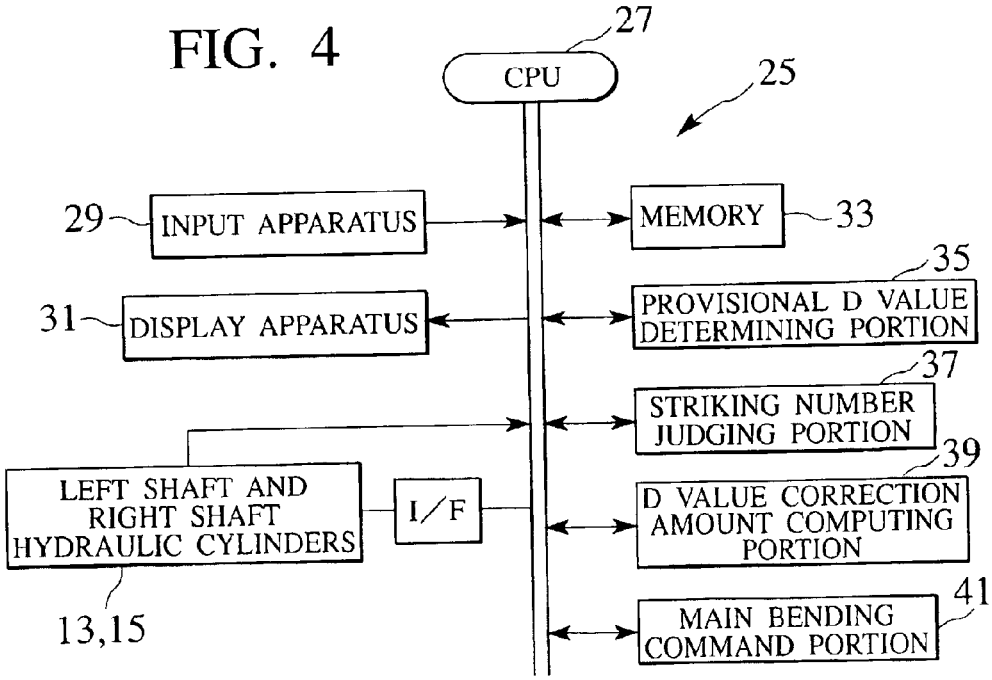
FIG. 4 is a block diagram of a control apparatus.

With reference to FIG. 4, in the control apparatus 25, a central processing unit (CPU) 27 is electrically connected to a bending process condition inputting means that inputs data such as a material of work W, a thickness, a worked shape, a metal mold condition, a target angle of bending and a working program in the work W, and the like. The CPU 27 is also electrically connected to a memory 33 that stores the input data. The bending process condition inputting means in FIG. 4 includes an input apparatus 29 and a display apparatus 31.

Further, a provisional D value determining portion 35 for determining a provisional D value (stroke amount) is electrically connected to the CPU 27. A strike (bending) number judging means for inputting or automatically detecting a strike(bending) number when the work W is struck until the predetermined angle is obtained is electrically connected to the CPU 27. The strike number judging means in FIG. 4 includes a strike number judging portion 37.

The CPU 27 is also electrically connected to a stroke value correction amount computing means for computing a D value correction amount for main bending. The D value is computed with respect to the predetermined angle on the basis of the strike number judged by the strike number judging portion 37. The stroke value correction amount computing means in FIG. 4 is a D value correction amount computing portion 39. The D value correction amount computing portion 39 computes a D value correction amount. The CPU 27 is further connected to a main bending command portion 41 which gives a command so that the main bending process is executed according to the main bending D value corrected on the basis of the D value correction amount.

On the basis of the structure mentioned above, a description will be given with reference to a flow chart in FIG. 2. For example, data of the material, the thickness, the bending length and the bending position of the work W, a metal mold condition such as a V width of the die, a step diameter DR of the die, a radius PR of a punch front end and the like, a predetermined angle and an actually measured angle corresponding to a target angle of bending, and the like are input as the bending process condition, by the input apparatus 29 of the control apparatus 25 (step S1).

The D value is calculated by the provisional D value determining portion 35 of the control apparatus 25 on the basis of the input data mentioned above. The D value becomes the provisional D value during the test bending (step S2).

The test bending process is executed by the provisional D value mentioned above. That is, after the control apparatus 25 is switched to the test bending mode and the work W is mounted on the die D, the manual pulser is rotated by the operator, the upper table 5 is driven at a minute speed, and the work W is bent. At this time, since the work becomes defective if the bending angle becomes tighter than the predetermined angle (more acute than the predetermined angle), the provisional D value is actually set so as to be always 1 degree to 2 degrees slacker than the predetermined angle. The test bending is executed on the basis of the provisional D value, and the bending angle of the work W is driven in.

That is, the operator drives the upper table 5 so as to bend the work W close to the predetermined angle while again rotating the manual pulser (S4). The operator takes out the work W (S6) and measures the bending angle. When the predetermined angle is not obtained (S7=NO), the operator again sets the work W on the die D and repeats the process from step S4 to step S7.

The number of times the work is struck (i.e., the strike number) until the predetermined angle (within an allowable value) is finally obtained, is input to the control apparatus 25. The strike number may be manually input by the operator by means of the input apparatus 29, or may be automatically input by being automatically counted, e.g., by a counter installed within the control apparatus 25. The strike number to be input is obtained, e.g., when the upper table 5 stops being counted by the control apparatus 25.

For example, on the assumption that the target angle is 90 degrees during the test bending, the operator pedals a foot pedal and the upper table 5 is automatically moved downward and stops when the bending angle becomes 92 degrees. Afterwards, the operator rotates the manual pulser so as to drive in the angle. Accordingly, the number of strikes before the upper table 5 stops descending is counted by the operator. Alternatively, the number detected by the strike number detecting apparatus, such as the detection sensor or the like, is automatically counted, e.g., by the counter. According to the manual or automatic manner mentioned above, the strike number is judged by the strike number judging portion 37 of the control apparatus 25 (step S8).

Further, as mentioned above, at a time when the predetermined angle is obtained by the test bending, the D value is registered in the memory 33 of the control apparatus 25 (step S9).

Figures 5, 6:
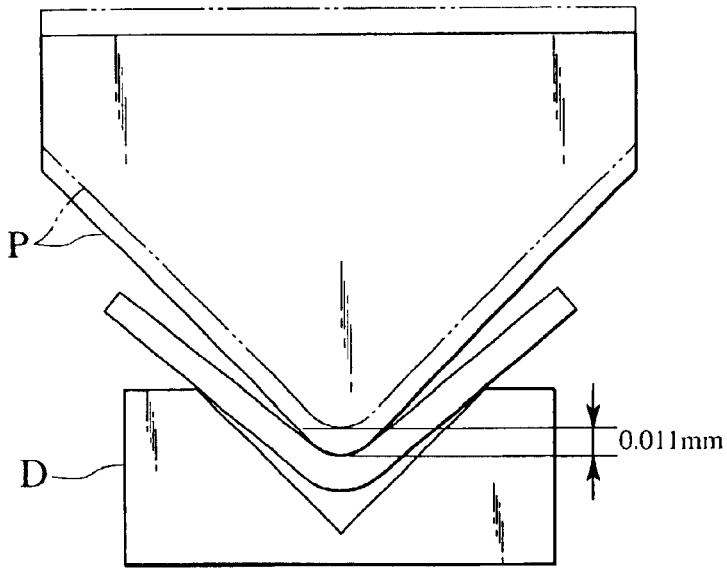
FIG. 5 is a correction value table showing a part of a multiple strike correction data base, according to an aspect of the present invention.
FIG. 6 is an explanatory schematic view explaining a D value correction amount for main bending, according to an aspect of the present invention.

With reference to FIG. 5, a D value correction amount is prepared using the data obtained during test bending. The D value correction amount corresponds to the number of times a test piece was struck until the target angle is obtained. That is, a multiple strike correction data base (a correction value table) is obtained.

For example, in the table shown in FIG. 5, a material of the work W is SUS304, a thickness thereof is 1.2 mm, an angle of the punch front end is 88 degrees, a V width of the die D is 6 mm, a step radius DR of the die D is 1.5 mm, and a radius PR of the punch front end is 0.6 mm. Under this condition, the test bending is executed with respect to each of the target angles 90 degrees, 100 degrees, 110 degrees, 120 degrees, 130 degrees and 140 degrees. The D value correction amount corresponds to the number of strikes (striking two to six times in the table) executed until each of the target angles is obtained.

In more detail, the D value correction amount is 0.011 mm for a time when the target angle is 90 degrees and the work is struck twice. The descending end of the punch P is at a position shown by a two-dot chain line in FIG. 6 when the work is struck twice to obtain the target angle of 90 degrees during test bending. However, it is necessary that the descending end of the punch P moves further downward to a position shown by a solid line in FIG. 6, e.g., at 0.011 mm, in order that the target angle becomes 90 degrees according to the main bending (single strike).

Figure 7:
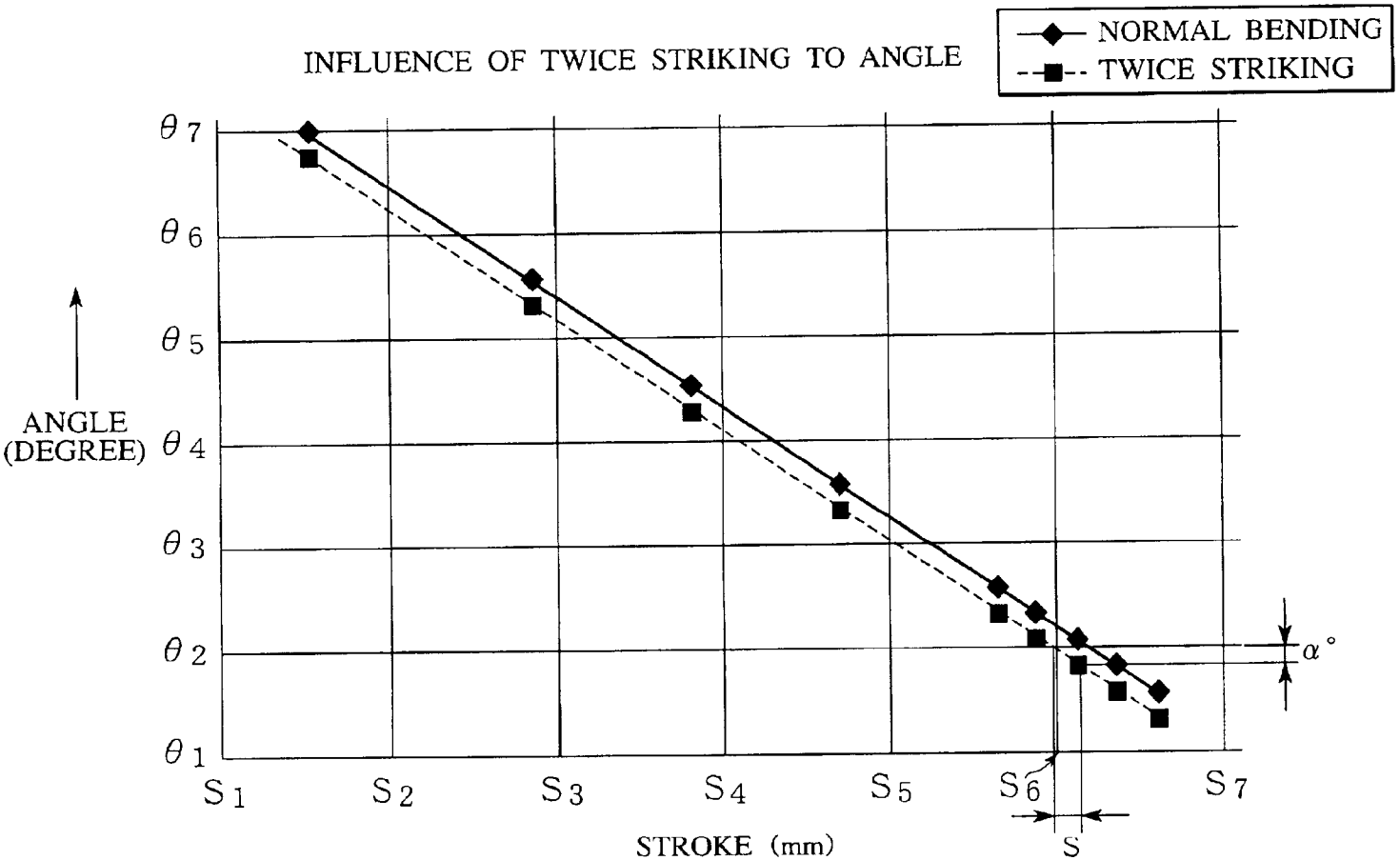
FIG. 7 is a graph showing an influence to an angle of striking a work twice.

FIG. 7 shows results when the work is bent once on the basis of a D value in comparison to a result when the work is bent twice (i.e., is bent, released once, and bent a second time) on the basis of the same D value. As is known from a graph in FIG. 7, in the case of two strikes during test bending, e.g., to obtain an angle of 90 degrees (position of θ 2 in FIG. 7), an actually measured value of the bending angle during test bending (i.e., with two strikes) is an angle α deeper (more acute) than that at the normal bending time.

In another respect, since the bending angle of 90 degrees is not obtained for the main bending when the main bending is executed, it is necessary that the main bending is executed by setting the stroke amount to the D value correction amount 5 mm which is deeper (additive) with respect to the D value used during the test bending executed with two strikes. The D value correction amount 5 mm corresponds to 0.011 mm in FIG. 5.

Next, the main bending process (the continuous bending process) is executed. At this time, the control apparatus 25 is switched to the continuous bending mode. On the basis of the strike number input by the operator in the step 58 or the automatically detected strike number, the D value correction amount corresponding to the target angle and the strike number is computed by the D value correction amount computing portion 39 of the control apparatus 25 on the basis of the multiple strike correction data base within the memory 33.

For example, on the assumption that the strike number at the test bending time mentioned above is two, the D value correction amount is computed by the D value correction amount computing portion 39 of the control apparatus 25 on the basis of the number of strikes during testing, the bending process condition, and the multiple strike correction data base within the memory 33. The number of strikes during testing is either input by the operator or automatically counted. The D value at the test bending time is registered in step S9. The D value at the test bending time is corrected by the D value correction amount, and the main bending D value (the stroke amount) at the main bending time is computed.

In this case, since the multiple strike correction data base mentioned above can be expressed by a computation formula (an experimental formula), e.g., D value correction amount=f (material, thickness, target angle, metal mold data and strike number), the D value correction amount may be computed (step S10).

The main bending process of a predetermined number of works W is executed according to the main bending D value corrected on the basis of the D value correction amount, by the command given from the main bending command portion 41 of the control apparatus 25 (steps S11 to S12).

Since the D value correction amount for the main bending is determined in advance on the basis of the predetermined angle, the number of strikes during test bending, and the bending process condition as mentioned above, and since the D value correction amount is made in the form of the computation formula (the experimental formula) or in the form of the data base for each of the bending process conditions, the main bending process is executed according to the main bending D value which is automatically corrected by the D value correction amount. Accordingly, even when the test bending is executed by the unskilled operator and the work is struck multiple times until the desired predetermined angle is obtained, it is possible to easily and effectively execute the stable bending process.

In this case, this invention is not limited to the embodiment mentioned above, and can be carried out on the basis of the other aspects by executing a proper modification.

We claim:

1. A bending method, comprising:

determining a provisional bending stroke value that results in a predetermined bend angle during test bending;

calculating a stroke value correction amount for correcting the provisional bending stroke value, based on a number of times a test piece is contacted to obtain the predetermined bend angle during test bending, and adding the stroke value correction amount to the provisional stroke value to obtain a corrected stroke value, so as to obtain the predetermined bend angle during operational bending using the corrected stroke value.

2. The bending method recited in claim 1, wherein the provisional bending stroke value is determined on the basis of a bending process condition.

3. The bending method recited in claim 1, further comprising:

reciprocating at least one of an upper table and a lower table based on the provisional bending stroke value; and executing a test bending process by cooperation of a punch attached to the upper table and a die attached to the lower table.

4. A bending apparatus, comprising:

a provisional stroke value calculator that determines a provisional bending stroke value that results in a predetermined bend angle during test bending;

a stroke value corrector that determines a stroke value correction amount for correcting the provisional bending stroke value, based on a number of times a test piece is contacted to obtain the predetermined bend angle during test bending, and an adder that adds the stroke value correction amount to the provisional stroke value to obtain a corrected stroke value, so as to obtain the predetermined bend angle during operational bending using the corrected stroke value.

5. The bending apparatus recited in claim 4, wherein the provisional bending stroke value is determined on the basis of a bending process condition.

6. The bending apparatus recited in claim 4, further comprising:

an upper table provided with a punch and a lower table provided with a die, at least one of the upper table and the lower table being reciprocated based on the provisional bending stroke valve, and a test bending process being executed by cooperation of the punch and the die.

* * * * *